United States Patent [19]

Wischusen, III

[11] Patent Number: 5,050,794

[45] Date of Patent: Sep. 24, 1991

[54] TAMPER-RESISTANT LEAKPROOF CONTAINER

[75] Inventor: Henry Wischusen, III, Lilburn, Ga.

[73] Assignee: Rock-Tenn Company, Norcross, Ga.

[21] Appl. No.: 449,597

[22] Filed: Dec. 12, 1989

[51] Int. Cl.[5] ..... B65D 5/22

[52] U.S. Cl. ..... 229/125.26; 229/179; 229/188

[58] Field of Search ..... 229/125.26, 179, 901, 229/186, 188

[56] References Cited

U.S. PATENT DOCUMENTS

| | | | |
|---|---|---|---|
| 546,767 | 9/1895 | Knobeloch | 229/179 |
| 742,159 | 10/1903 | Burton | 229/179 |
| 895,218 | 8/1908 | Weston . | |
| 930,953 | 8/1909 | Freund | 229/179 |
| 1,146,307 | 7/1915 | Butler | 229/179 |
| 1,307,638 | 6/1919 | Pridham . | |
| 1,364,839 | 1/1921 | Gereke | 229/179 |
| 1,400,060 | 12/1921 | Heim | 229/179 |
| 1,704,175 | 3/1929 | Coale . | |
| 2,288,056 | 6/1942 | Wentz . | |
| 2,307,720 | 1/1943 | Ringler . | |
| 2,391,767 | 12/1945 | Beerend . | |
| 2,456,841 | 12/1948 | Rushing | 229/125.26 |
| 2,711,282 | 6/1955 | D'Esposito | 229/179 |
| 2,805,813 | 9/1957 | Rittmueller . | |
| 2,856,114 | 10/1958 | Guyer . | |
| 2,955,737 | 10/1960 | Arneson . | |
| 2,967,654 | 1/1961 | Palmer . | |
| 2,982,464 | 5/1961 | Wingate . | |
| 3,306,516 | 2/1967 | Taylor, Jr. . | |
| 3,393,859 | 7/1968 | Giummo . | |
| 3,463,379 | 8/1969 | Dlugopolski . | |
| 3,567,106 | 3/1971 | Anderson | 229/186 |
| 3,608,811 | 9/1971 | Frick . | |
| 3,627,541 | 12/1971 | Farquhar . | |
| 3,722,782 | 3/1973 | Collie . | |
| 3,743,169 | 7/1973 | Person . | |
| 3,902,653 | 9/1975 | Persson . | |
| 3,917,155 | 11/1975 | Bemiss . | |
| 3,964,669 | 6/1976 | Sontag et al. . | |
| 4,196,843 | 4/1980 | Garmon | 229/125.26 |
| 4,208,007 | 6/1980 | Bamburg et al. | 229/188 |
| 4,265,393 | 5/1981 | Orchard . | |
| 4,335,830 | 6/1982 | Garganese . | |
| 4,558,815 | 12/1985 | Wischusen, III . | |
| 4,610,885 | 9/1986 | Tait . | |
| 4,651,919 | 5/1987 | Wischusen, III . | |
| 4,723,700 | 2/1988 | Wischusen, III . | |
| 4,747,536 | 5/1988 | Wischusen, III . | |

FOREIGN PATENT DOCUMENTS

| | | | |
|---|---|---|---|
| 700533 | 12/1964 | Canada . | |
| 2530219 | 1/1984 | France | 229/179 |

*Primary Examiner*—Gary E. Elkins

*Attorney, Agent, or Firm*—Jones, Askew & Lunsford

[57] ABSTRACT

A leak proof disposable enclosed container combines a gusseted paperboard or corrugated board structure with seamless construction. The container is held erect without piercing the structure by locking tabs which enter openings in connecting panels which are foldably connected to the container walls. The top and bottom components of the container are restrained from separation by tamper tabs, which are linked to the container walls and provide anti-separative contact between the top and bottom halves of the container.

16 Claims, 4 Drawing Sheets

101
12
14
16
20
22
30
32
40
42
44
50
52
54
60
62
64
66
70
72
74
76
77
78
80
84

TAMPER-RESISTANT LEAKPROOF CONTAINER

FIELD OF INVENTION

The present invention relates to an end construction for a collapsible container, and more particularly relates to an enclosed leakproof container formed from a blank of corrugated cardboard or heavy paperboard, which is self-securing against accidental opening.

BACKGROUND OF THE INVENTION

Paperboard and corrugated containers are used extensively in all facets of commercial and domestic life. A multitude of paperboard containers exist, each generally designed for either a wide or specialized area of use. Shipping containers account for a large segment of the commercial market for containers. An example of a specialized area requiring containers specially constructed for its needs is the fishing industry. In preparation for shipping, fish are generally cleaned and frozen. The forzen fish are then placed in a shipping container along with a cooling material, such as dry ice or reusable ice packs. The demands placed on containers used to ship fish and other frozen goods are great. To adequately protect the cargo, the container must be strudy, moisture and leak resistant, insulating, and resistant to unauthorized or accidental opening. In addition, since mass quantities of containers are used and the fish processing center is often in an isolated area, such as Alaska, the container must not occupy a lot of area when unassembled, must be easily and quickly assembled, and must be economical, preferably capable of repeated use.

One example of a fish container used by many guide services in Alaska is a container made from corrugated board blanks having a wax-like coating. A bottom component and a top component of the container are made from blanks of the coated board. The use of one piece blanks allows easy shipment and storage of the containers prior to assembly. The top and bottom components are identical in construction, except that the blank from which the bottom is constructed is slightly smaller than the blank for the top. The bottom and top each have seamless construction, utilizing internal gussets, foldably connected to a side and end panel. The gussets are secured to the end flap, thereby affecting erection of each container, by use of multiple staples which pierce the end panels and gussets.

The staples, however, violate the integrity of the end panels. Additionally, removal of the staples when disassembling the containers tears the end panels, such that each container may not be assembled and disassembled repeatedly. To maintain closure of an enclosed container made from a top and bottom component, twine tape or other securing devices are wrapped around the container, and are therefore an additional expense of shipping.

Another example is a container constructed from corrugated board blanks having a foil laminate applied to its surfaces. This container utilizes two blanks to form an enclosed container. The bottom component has an end construction utilizing connecting panels attached to side and end panels, and a retention panel and locking tab. The retention panels fold exterior to the end panels and overlap connecting panels folded against the exterior surface of each end panel. The locking tab is slidably positioned in the space created by the interdsection of the connecting panels. The top component is of conventional construction, utilizing internal gussets adhesively secured to the interior of the side panels.

Many containers are found in the prior art which are manufactured from one piece paperboard blanks. One example of a container which is leakproof and securable against accidental opening without the use of other devices, such as twine or tape is U.S. Pat. No. 4,238,069. The '069 patent describes a one-piece container having wall and gusset panels positioned around a central bottom panel. The gusset panels fold into the container in a conventional leakproof arrangement. In order to prevent the gusset panels from occupying usable space within the container, special flaps attached to the ends walls hold the gussets against the end walls. Cover panels come together over the container to form a handle, and slotted projections attached to the gusset panels engage tabs on the handle to maintain the closed configuration. The inner surface of the paperboard is coated with a waterproof coating or impregnated with a water impervious material to allow carrying perishables and ice. This container may be repeatedly assembled and disassembled. However, because of the handle this apparatus is not well suited for shipping.

Canadian Patent No. 700,533 discloses a siftproof carton, designed for the shipment of powdered or pulverized material such as granulated soap. Assembly of this leakproof shipping container requires the use of glue or other adhesives.

Despite the various efforts found in the prior art, there remains a need for a reusable container which can be made secure and leakproof without having to utilize tape, glue or other securing devices to secure against accidental opening, and which can be assembled from a single blank capable of repeated assembly and disassembly.

SUMMARY OF THE INVENTION

The present invention advances the art by providing an end construction that can be utilized in the construction of a leakproof, tamper resistant disposable having a gusseted corner structure. The end construction holds the container erect for loading or unloading without adhesive by locking tabs which enter openings in the gusset panels. Tamper tabs can be included to provide anti-separative contact between the top and bottom components of the container preventing unintentional opening of the container.

Generally described, the present invention provides an end construction for a container, comprising a bottom panel, a side panel extending upwardly from the bottom panel, an end extending upwardly from the bottom panel adjacent to the side panel, a connecting panel connected to the side panel and having an opening defined therethrough, the connecting panel being folded against the end panel, a retention panel foldably connected to the upper most horizontal edge of the end panel and being folded down against the connecting panel, and a locking tab defined in the retention panel and extending into the opening in the connecting panel.

According to a preferred embodiment, the present invention provides a disposable leak proof enclosed container, comprising a top container and a bottom container, each being erected from identical blanks of foldably sheet material. The top and bottom containers each comprise a top or bottom panel, respectively; a pair of side wall panels foldably attached along opposite sides of the top or bottom panel; a pair of end wall panels foldably attached to the top or bottom panel between the side wall panels; a first connecting panel foldably connected to each end of each side panel; a second connecting panel foldably connected to each end of each end panel, and each first connecting panel being foldably connected to each adjacent second connecting panel; a retention panel foldably connected to each of the end panels, each retention panel defining a pair of locking tabs adapted to be received in a first opening defined in each first connecting panel, with passage of the locking tab into the first opening facilitated by a second opening defined in each second connecting panel; and each of the retention panels defining tamper tabs positioned so that the tamper tabs of the top container contact the tamper tabs of the bottom container when separative force is applied to erected container.

The preferred construction of the present invention provides a tamper resistant container. When the top container is placed over the bottom container an enclosed container is formed which is resistant to unauthorized or unintentional opening without requiring the use of external media, such as tape or string. The seamless construction of the container, which incorporates gussetted construction without piercing the side or end walls of the container prevents leakage of materials from the container. A foil, plastic, or multi-layer foil and plastic laminate may further be applied to the sheet material further enhancing the leakproof and insulating qualities of the container.

Thus, it is an object of the present invention to provide an improved disposable container.

It is a further object of the present invention to provide an improved corner construction for a tray-like container or a cover therefor.

It is a further object of the present invention to provide a gussetted container of seamless construction.

It is a further object of the present invention to provide a tamper resistant disposable container.

It is a further object of the present invention to provide a disposable container that can be erected without adhesive and supports itself for loading or unloading.

Other objects, features, and advantages of the present invention will become apparent upon reading the following detailed description of an embodiment of the invention, when taken in conjunction with the accompanying drawings and the appended claims.

DETAILED DESCRIPTION

Figure 1:
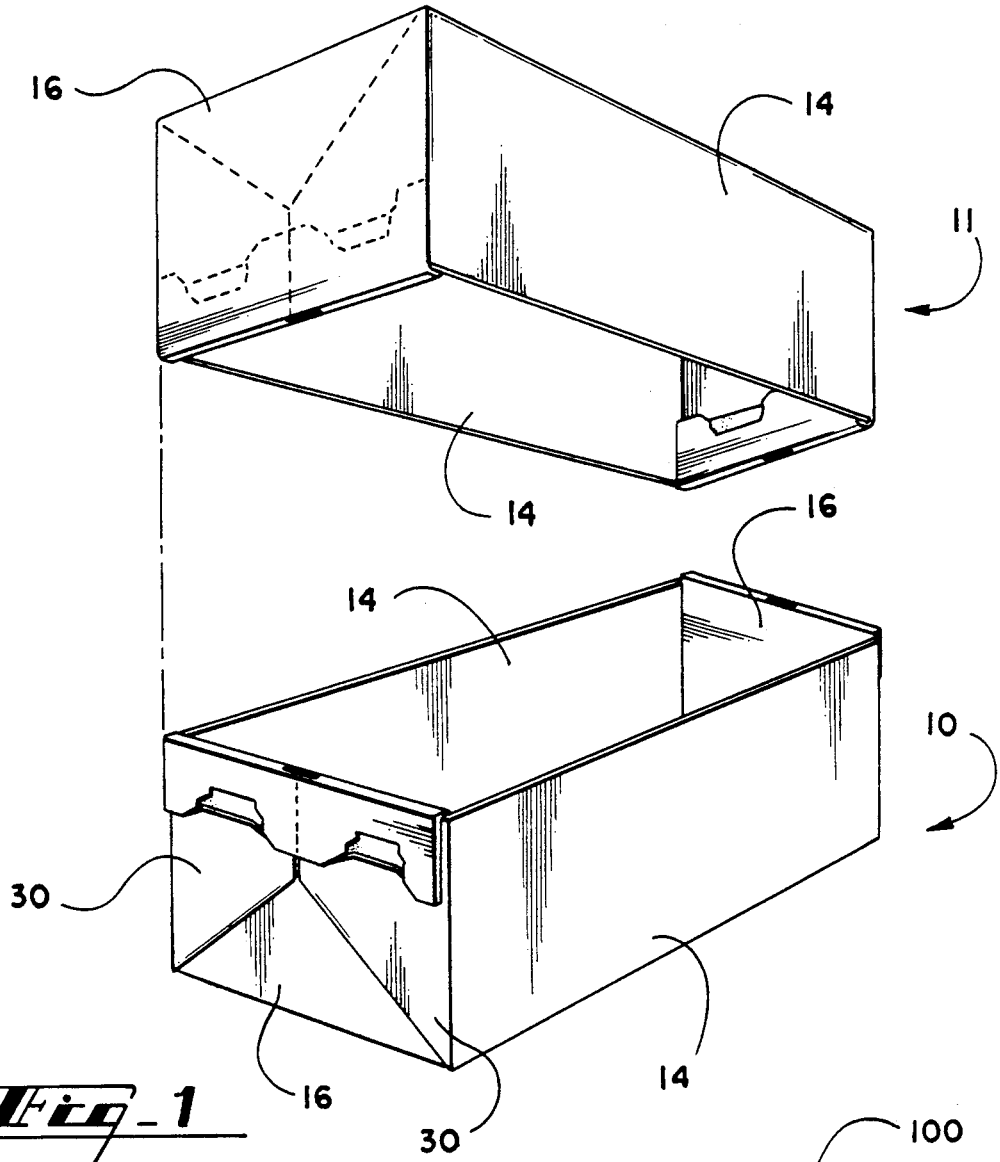
FIG. 1 is a pictorial view of a preferred embodiment having a container top and a container bottom which form an enclosed container according to the invention.
Figure 7:
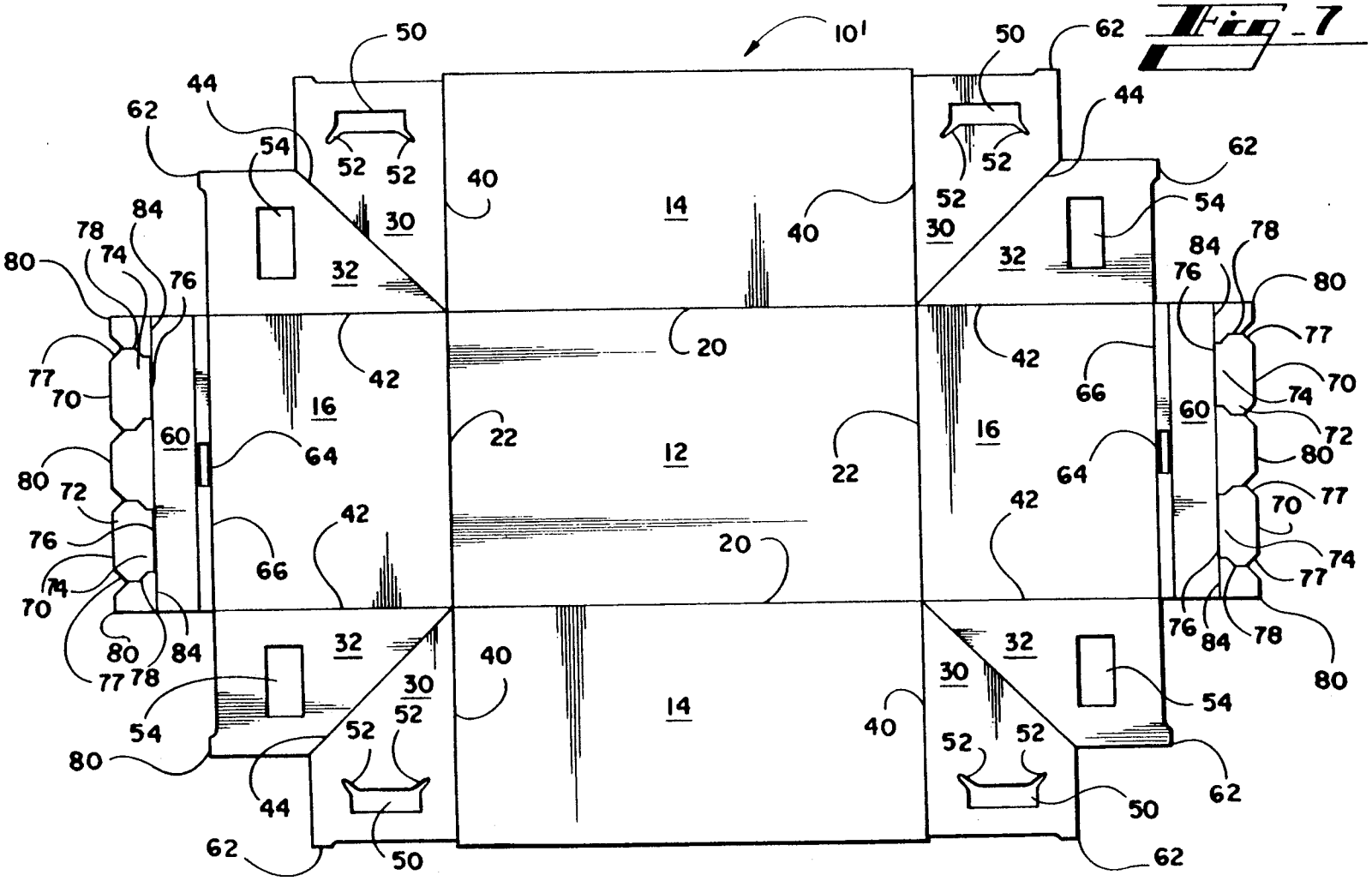
FIG. 7 is a plan view of the blank used to form a container top and bottom as shown in FIG. 1.

Referring now to the drawings, in which like numerals refer to like parts throughout the several views, FIG. 1 shows an open-top container 10 embodying the present invention, fully erected and locked. The blank 10' from which the container 10 is assembled is shown in FIG. 7.

The container 10 includes a bottom panel 12 in the center of the blank 10'. A pair of side panels 14 are foldably connected to opposite sides of the bottom panel 12 along scores or fold lines 20. A pair of end panels 16 are foldably connected to the other opposite sides of the bottom panel 12 along scores 22. A connecting panel 30 is foldably connected along each of a plurality of scores 40 to each end of each of the side panels 14. An additional connecting panel 32 is foldably connected along each of a plurality of scores 42 to each end of each of the end panels 16. Each connecting panel 30 is foldably connected along scores 44 to the connecting panel 32 adjacent to each of the connecting panels 30. A retention tab 62 extend upwards from each upper edge of the connecting panels 30 and 32 and extends into a retention opening 64 as described below.

Each of the connecting panels 30 defines a first opening 50 therethrough into which a locking tab 70, described below, is inserted. To help each locking tab 70 enter into and be secured within each first opening 50, the first opening 50 is preferably rectangular in shape and defines angled slots 52 extending from the lower corners of the rectangular. Each of the connecting panels 32 defines a second opening 54 therethrough, at least partly overlapping the first opening 50 when the container 10 is erected. Each second opening 54 is preferably rectangular in shape to provide clearance to help the locking tab 70 slide into the first opening 50.

Extending upwardly from and foldably connected along scores 66 to the upwardly extending edges of each of the end panels 16 is a retention panel 60. Each retention panel 60 is shaped to cover, when the container 10 is erected, the area of each connecting panel 30 which extends upwardly from the first opening 50 to the upper edge of the connecting panel 30. Each retention panel 60 defines a pair of locking tabs 70, which are slidably inserted into the first openings 50. The locking tabs 70 each have a head portion 72 extending outwardly from a neck portion 74, with the neck portion 74 foldably connected to the outermost horizontal edge of the retention panels 60, along scores 76. The head portion 72 of each locking tab 70 is wider than the first openings 50 and has a plurality of bevelled corners 77 positioned to pass into the slots 52. The head portion 72 also defines a plurality of angled edges 78 positioned to be trapped by the slots 52 when the head portion 72 is inserted into the first opening 50. Each of the scores 66 defines a retention opening 64 along a portion of each of the scores 64, into which the retention tabs 62 extend, as shown in FIG. 1.

Extending from the retention panels 60 and located adjacent to the locking tabs 70 are tamper tabs 80, positioned so that an unexposed surface 82 of each of the tamper tabs 80, best shown in FIG. 8, faces each of the connecting panels 30 when the container 10 is erected. The tamper tabs 80 are foldably connected to the retention panels 60 along scores 84.

Figure 3:
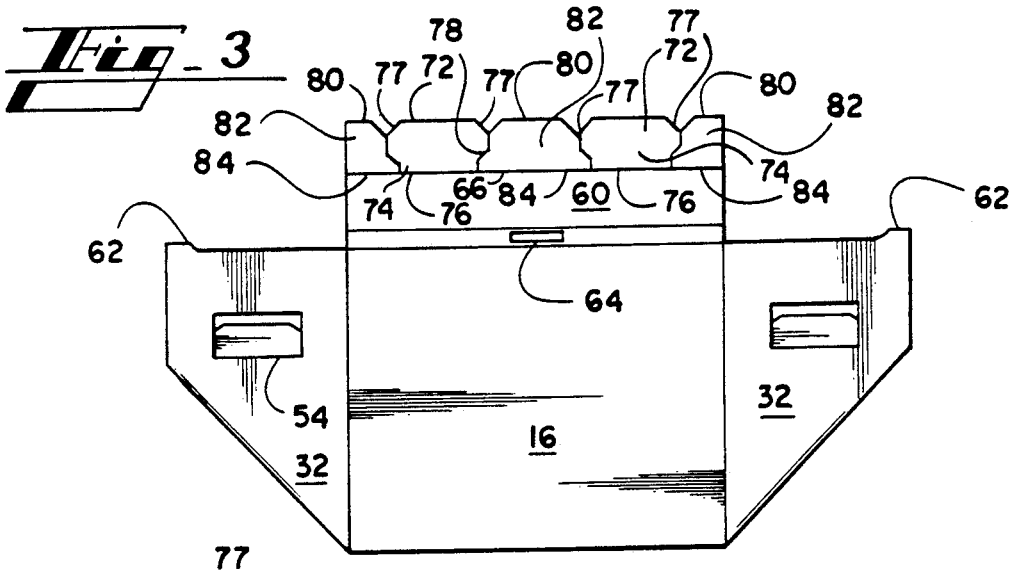
FIG. 3 is an end plan view of the container bottom of FIG. 1, showing the relation of the connecting panels and retention panel before the container is completely erected.
Figure 4:
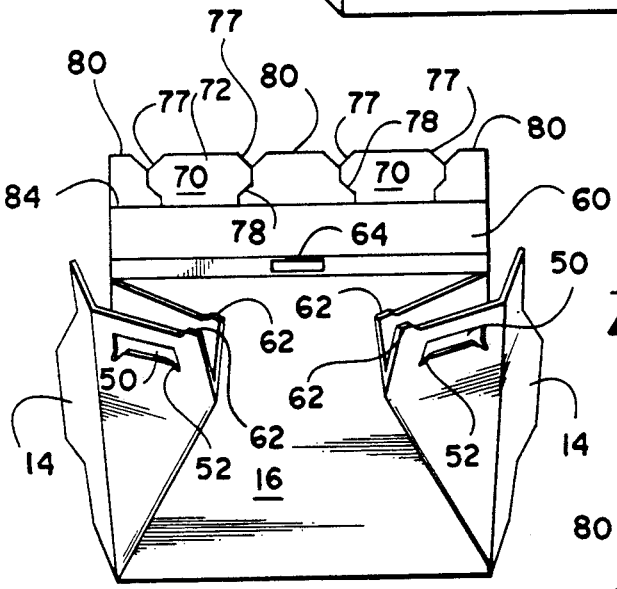
FIG. 4 is an end plan view of the container bottom of FIG. 1, showing the connecting panels being folded toward the end panel.
Figure 5:
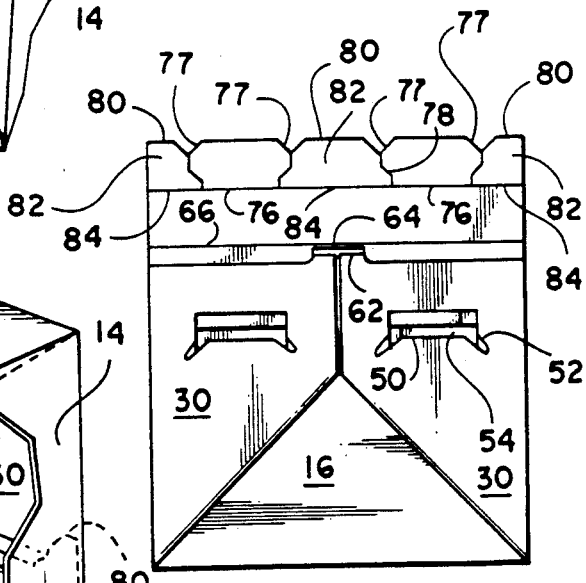
FIG. 5 is an end plan view of the container bottom of FIG. 1, showing the connecting panels folded against the end panel.

To assemble the blank 10' into the container 10, the side panels 14 may be raised relative to the bottom panel 12 by folding about the scores 20. Simultaneously, folds may be made about the scores 22, 40, 42 and 44, raising the connecting panels 30 and 32 and the end panels 16, respectively, shown in FIG. 3. As will be apparent to one skilled in the art, folding about the scores 40 and 42 may be made to orientate the connecting panels 30 and 32 either within or exterior to the raised side panels 14 and end panel 16. FIGS. 3–5 show the connecting panels 30 and 32 being folded exterior to the side panels 14 and end panel 16. The connecting panels 30 and 32 may be folded about the scores 46 such that each connecting panel 32 is parallel to and in contact with either the exterior or interior face of each end panel 16, the connecting panels being shown exterior to end panel 16 in FIG. 5. In this event, one face of the connecting panel 30 is parallel to and in contact with the connecting panel 32 and the other face of the connecting panel 30 is exposed. The same folding action brings the retention tabs 62 on adjacent panels 30 and 32 into alignment.

It will be seen that the container 10 may be formed using locking tabs as described above while utilizing only connecting panels 30, or only connecting panels 32, or a combination thereof. It will further be seen that connecting panels 30 and 32 are not required to be foldably connected along scores 44.

To form the open bottom portion 10, the connecting panels are folded exterior to the side and end panels, as shown in FIG. 3. Then the adjacent connecting panels are folded toward the end panels 16, as shown in FIG. 4. The connecting panels 32 are then oriented parallel to and in contact the exterior face of end panel 16, as shown in FIG. 5. The retention panels 60 may then be folded about the scores 66 downwards against said connecting panels 30 and 32 with the aligned pairs of retention tabs 62 contained within the retention openings 64. When the retention panels 60 are folded against the connecting panels, 30 and 32 the head portion 72 of the locking tabs 70 may be inserted into the first opening 50, so that the bevelled corners 76 pass through the slots 52, and the edges 78 lock in the slots 52, as shown in FIGS. 1 and 8. The second opening 54 provides clearance to help the head portion 72 slide into the first opening 50, as shown in FIG. 8. When fully inserted the locking tabs 70 will remain locked in the slots 52 unless the tabs are manipulated intentionally to allow them to pass back through the slots, which may be done to disassemble the container. When all four locking tabs 70 are inserted into the slots 52, the container is erected and ready for loading. This locking arrangement not only maintains closure, but also provides a leak proof container by utilizing seamless construction. The container 10 may be repeatedly disassembled and assembled.

As will be apparent to one skilled in the art, the retention panels 60 may alternatively be foldably connected to the side panels 14 and the connecting panels 30 and 32 may be folded against the side panels, so that the retention panels fold down over the side panels to allow insertion of the locking tabs 70.

Figure 2:
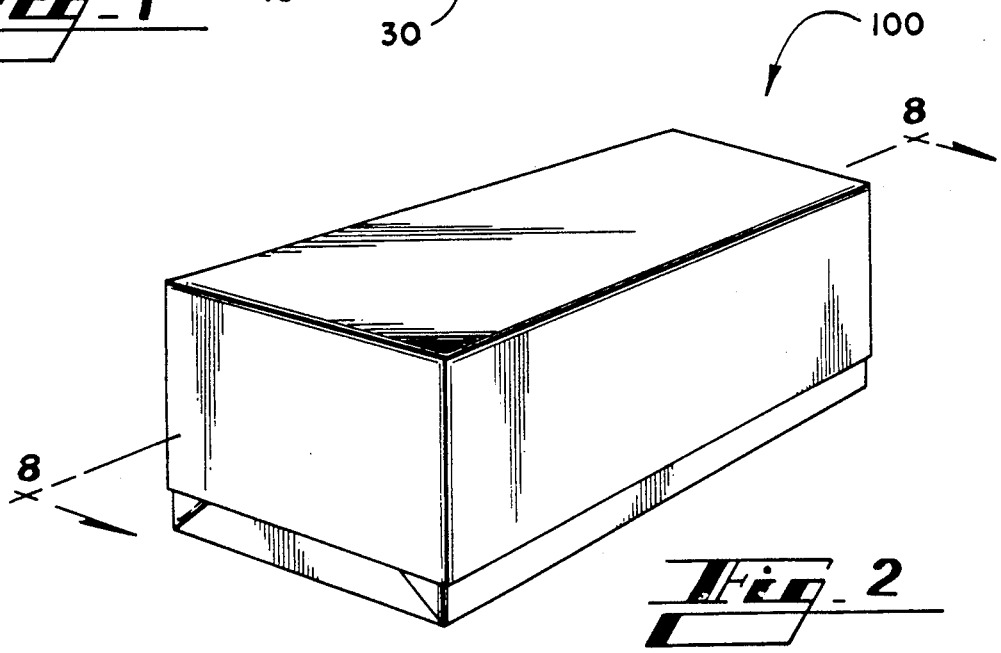
FIG. 2 is a pictorial view of a preferred embodiment of an enclosed container according to the invention.
Figure 6:
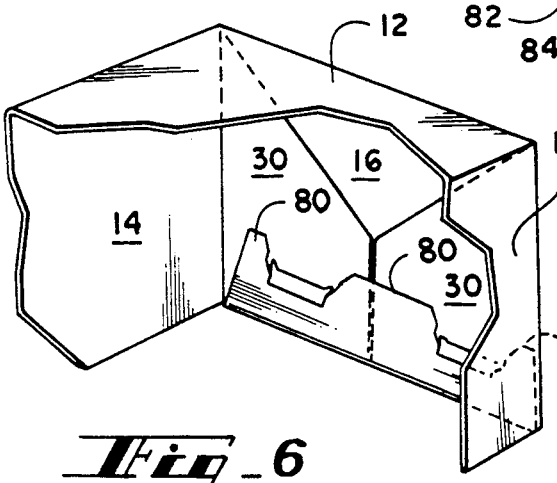
FIG. 6 is a perspective view of an interior end of the top container of FIG. 1.

As previously explained, the connecting panels 30 and 32 may be folded against either the interior or exterior of the end walls. A container top 11 shown in FIGS. 1 and 6, formed in the same manner as the container 10, is made by positioning the connecting flaps 30 and 32 interior to the side and end panels. The top container 11 may then be placed over the bottom container 10 to form an enclosed container 100, shown in FIGS. 1 and 2.

Figure 8C:
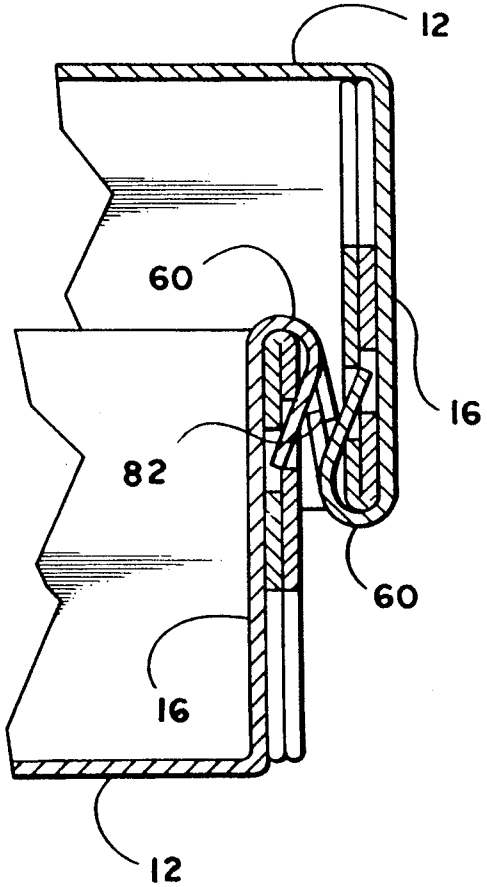
FIGS. 8(*a*), 8(*b*) and 8(*c*) are horizontal cross sectional views of the container, taken along line 8—8 of FIG. 2, showing the relation of the tamper tabs in the closed container, the relation of the tamper tabs as the container top is moved upwards in relation to the container bottom, and the relation of the tamper tabs when the tamper tabs contact one another.
Figure 8B:
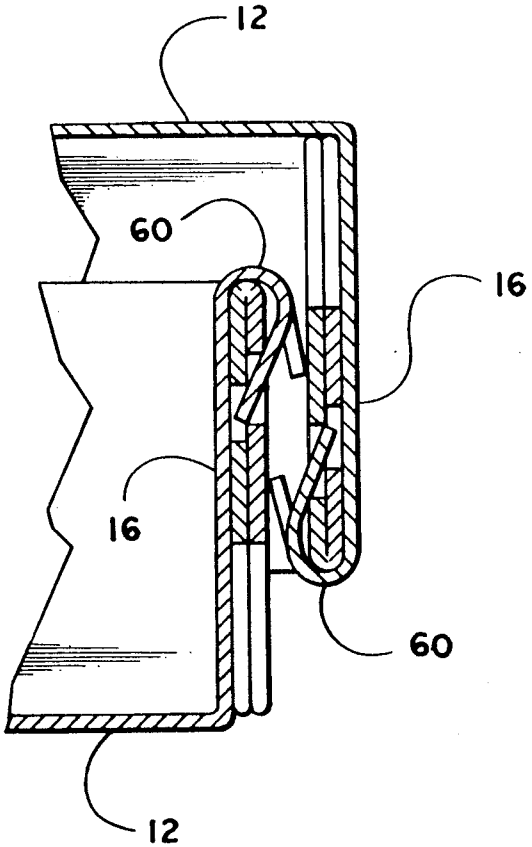
Figure 8A:
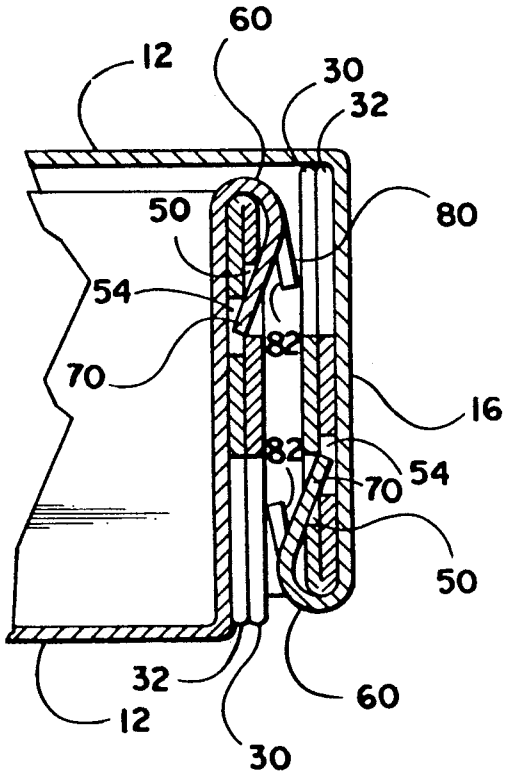

FIG. 8 shows diagrammatically how the tamper tabs 80 prevent separation of the bottom container 10 and the top container 11 when the top container 11 is placed over the bottom container 10 to form an enclosed container 100. At least one surface of one of the tamper tabs 80 of the bottom container 10 physically contacts at least one surface of one of the tamper tabs 80 of the top container 11 when the top container is moved upwards in relation to the bottom container. This physical contact preferably occurs between unexposed surfaces 82, as shown in FIGS. 8A, 8B and 8C. FIG. 8A shows the fully closed container. In FIG. 8B, the top 11 has been partly raised. In FIG. 8C, the respective tamper tabs 80 have become hooked to prevent further upward movement of the top 11. In some instances the cut edges of the tabs 80 may catch on one another rather than passing behind one another as shown. This phyiscal contact prevents accidental separation of the top and bottom containers, absent force sufficient to damage the tamper tabs 80. The containers 10 and 11 may be separated by carefully manipulating the tamper tabs to allow each tamper tab 80 to pass by its counterpart.

It will be seen that the enclosed container 100 provides a leakproof, tamper resistance container. No glue or other medium is necessary in assembling or securing the container against accidental opening. Because of the ease with which the container 100 may be assembled, it is versatile enough to be sold flat for assembly by the customer.

While this invention has been described in detail with particular reference to a preferred embodiment thereof, it will be understood that variations and modifications can be made without departing from the spirit and scope of the invention as described hereinbefore and as defined in the following claims.

What is claimed is:

1. An enclosed container, comprising:

a top, comprising:

a top panel;

a plurality of exterior side panels having interior surfaces and extending downwardly from said top panel;

a first top connecting panel foldably connected to a first of said exterior side panels;

a second top connecting panel foldably connected to a second of said exterior side panels and to said first top connecting panel;

said top connecting panels being positioned against one another and against the interior surface of one of said exterior side panels such that one of said top connecting panels is exposed, the one of said top connecting panels that is exposed defining a first opening therethrough;

a top retention panel foldably connected to the lowermost horizontal edge of said one exterior side panel, said top retention panel being folded up against said exposed top connecting panel; and a top locking tab defined in said top retention panel, said top locking tab extending into said first opening in said exposed top connecting panel; and a bottom, comprising:

a bottom panel;

a plurality of interior side panels having exterior surfaces and extending upwardly from said bottom panel;

a first bottom connecting panel foldably connected to a first of said interior side panels;

a second bottom connecting panel foldably connected to a second of said interior side panels and to said first bottom connecting panel;

said bottom connecting panels being positioned against one another and against the exterior surface of one of said interior side panels such that one of said bottom connecting panels is exposed, the one of said bottom connecting panels that is exposed defining a second opening therethrough;

a bottom retention panel foldably connected to the uppermost horizontal edge of said one interior side panel, said bottom retention panel being folded down against said exposed bottom connecting panel; and a bottom locking tab defined in said bottom retention panel, said bottom locking tab extending into said second opening in said exposed bottom connecting panel.

2. The enclosed container of claim 1, wherein said top is positioned over said bottom so that the interior surfaces of said top connecting panels face the exterior surfaces of said bottom connecting panels.

3. The enclosed container of claim 2, further comprising:

a bottom tamper tab extending from said bottom retention panel and positioned so that an unexposed surface thereof faces said bottom connecting panels;

a top tamper tab extending from said top retention panel and positioned so that an unexposed surface thereof faces said top connecting panels.

4. The enclosed container of claim 3, wherein said unexposed surfaces of said tamper tabs come in contact when said top panel is moved upwards in relation to said bottom panel.

5. The enclosed container of claim 3, wherein at least one surface of one of said tamper tabs contacts at least one surface of another of said tamper tabs when said top panel is moved upward in relation to said bottom panel.

6. A composite one piece blank of foldable sheet material for forming a container, said blank comprising:

a bottom panel;

a pair of side panels foldably connected along opposite sides of said bottom panel;

a pair of end panels foldably connected to said bottom panel between said side panels;

a first connecting panel foldably connected to each end of said side panels, each first connecting panel defining a first opening therethrough;

a second connecting panel foldably connected to each end of said end panels, each second connecting panel defining a second opening therethrough;

a retention panel foldably connected an outermost edge of each of said end panels opposite said bottom panel; and a pair of locking tabs extending outwardly from each retention panel, and positioned to align with said first and second openings.

7. A container formed of foldable sheet material, said container comprising:

a bottom panel;

a side panel extending upwardly from said bottom panel;

an end panel extending upwardly from said bottom panel adjacent to said side panel and defining an uppermost horizontal edge;

a first connecting panel foldably connected to said side panel, said first connecting panel defining a first opening therethrough;

a second connecting panel foldably connected to said end panel, said second connecting panel defining a second opening therethrough at least partially overlapping said first opening;

one side of said second connecting panel being positioned against said end panel and said first connecting panel being positioned against the other side of said second connecting panel;

a retention panel foldably connected to the uppermost horizontal edge of said end panel, said retention panel being folded down against said first connecting panel; and a locking tab defined on said retention panel, said locking tab extending into said first opening in said first connecting panel.

8. The container of claim 2, wherein said locking tab comprise a head portion and a neck portion.

9. The container of claim 8, wherein said neck portion is foldably connected to the outermost horizontal edge of said retention panel and said head portion extends outwardly from said neck portion.

10. The container of claim 9, wherein said head portion is wider than said first opening, and has a beveled corner positioned to pass into said slot.

11. The container of claim 10, wherein said head portion further defines an edge positioned to be trapped by said slot when said head portion is inserted into said first opening.

12. The container of claim 7, wherein said second opening is rectangular in shape.

13. The container of claim 7, further comprising a retention opening defined along a portion of the fold connecting said retention panel to said end panel and a retention tab extending from an upper edge of each of said connecting panels, each of said retention tabs extending into said retention opening.

14. The container of claim 7, wherein said first opening is rectangular in shape and defines a cutout slot extending outwardly from each bottom corner of said first opening; and said locking tab defining a side edge on each opposite side of said locking tab, said side edges partially extending into said first opening such that each one of said side edges contacts an edge of one of said slots to frictionally maintain a portion of said locking tab within said opening.

15. A container formed of foldable sheet material, said container comprising:

a bottom panel;

a side panel extending upwardly from said bottom panel;

an end panel extending upwardly from said bottom panel adjacent to said side panel and defining an uppermost horizontal edge;

a connecting panel foldably connected to said side panel, said connecting panel defining a opening therethrough, said opening comprising a rectangular opening having an angled cutout slot extending outwardly from each bottom corner of said opening;

a retention panel foldably connected to the uppermost horizontal edge of said end panel, said retention panel being folded down against said connecting panel; and a locking tab defined on said retention panel and positioned to partially extend into said opening, said locking tab comprising:

a neck portion foldably connected to said retention panel; and a head portion connected to said neck portion, said head portion defining an angled edge extending from said neck at an angle such that said angled edge is parallel to said angled slot when said locking tab is partially extended into said opening.

16. A container formed of foldable sheet material, said container comprising:

a bottom panel;

a first side panel extending upwardly from a first side of said bottom panel;

a second side panel extending upwardly from a second side of said bottom panel;

a first end panel extending upwardly from a first end of said bottom panel adjacent to said first side panel;

a second end panel extending upwardly from a second end of said bottom panel adjacent to said second side panel;

a first connecting panel foldably connected to said first side panel, said first connecting panel defining a first opening therethrough;

a second connecting panel foldably connected to said first end panel, said second connecting panel defining a second opening therethrough at least partially overlapping said first opening;

a third connecting panel foldably connected to said second side panel, said third connecting panel defining a third opening therethrough;

a fourth connecting panel foldably connected to said second end panel, said fourth connecting panel defining a fourth opening therethrough at least partially overlapping said third opening;

one side of said second connecting panel being positioned against said first end panel and said first connecting panel being positioned against the other side of said second connecting panel;

one side of said fourth connecting panel being positioned against said second end panel and said third connecting panel being positioned against the other side of said fourth connecting panel;

a first retention panel foldably connected to an uppermost horizontal edge of said first end panel, said first retention panel being folded down against said first connecting panel;

a second retention panel foldably connected to an uppermost horizontal edge of said second end panel, said second retention panel being folded down against said third connecting panel;

a first locking tab defined on said first retention panel, said first locking tab extending into said first opening in said first connecting panel; and a second locking tab defined on said second retention panel, said second locking tab extending into said third opening in said third connecting panel.

* * * * *